US012084265B2

(12) United States Patent
Manfrinato Cambria

(10) Patent No.: US 12,084,265 B2
(45) Date of Patent: Sep. 10, 2024

(54) EXTENDABLE CONTAINER FOR FLUIDS WITH VARIABLE CONTAINMENT VOLUME AND DIMENSIONS

(71) Applicant: Luciana Christina Manfrinato Cambria, Curitiba (BR)

(72) Inventor: Luciana Christina Manfrinato Cambria, Curitiba (BR)

( * ) Notice: Subject to any disclaimer, the term of this patent is extended or adjusted under 35 U.S.C. 154(b) by 188 days.

(21) Appl. No.: 17/615,501

(22) PCT Filed: Jun. 3, 2019

(86) PCT No.: PCT/BR2019/050200
§ 371 (c)(1),
(2) Date: Nov. 30, 2021

(87) PCT Pub. No.: WO2020/243800
PCT Pub. Date: Dec. 10, 2020

(65) Prior Publication Data

US 2022/0315318 A1 Oct. 6, 2022

(51) Int. Cl.
*B65D 88/00* (2006.01)
*A47K 3/06* (2006.01)
*E04H 4/00* (2006.01)

(52) U.S. Cl.
CPC ..... *B65D 88/005* (2013.01); *A47K 3/06* (2013.01); *E04H 4/00* (2013.01)

(58) Field of Classification Search
CPC ..... E04H 4/06–065; A47K 3/06
USPC ..... 4/501
See application file for complete search history.

(56) References Cited

U.S. PATENT DOCUMENTS

| | | | | |
|---|---|---|---|---|
| 4,106,134 | A | 8/1978 | Rupprath | |
| 5,678,253 | A * | 10/1997 | Baker | E04H 4/065 254/89 R |
| 6,640,504 | B2 * | 11/2003 | Pearlson | E04H 4/065 52/126.5 |
| 10,072,432 | B2 | 9/2018 | Weijers et al. | |
| 2010/0199416 | A1 | 8/2010 | Demoisson et al. | |
| 2015/0040309 | A1 * | 2/2015 | Sundberg | A47K 3/024 4/572.1 |
| 2015/0059078 | A1 * | 3/2015 | Mariton | E04H 4/144 4/495 |
| 2015/0292220 | A1 | 10/2015 | Weijers et al. | |
| 2017/0356207 | A1 * | 12/2017 | Henry | E04H 4/12 |

FOREIGN PATENT DOCUMENTS

| | | | |
|---|---|---|---|
| CN | 202031352 | U | 11/2011 |
| CN | 207673067 | U | 7/2018 |
| CN | 108798086 | A | 11/2018 |
| CN | 208152634 | U | 11/2018 |
| DE | 20317102 | U1 | 2/2004 |

(Continued)

OTHER PUBLICATIONS

International Search Report and Written Opinion from International Application No. PCT/BR2019/050200 mailed Dec. 2, 2020.

*Primary Examiner* — Christine J Skubinna
(74) *Attorney, Agent, or Firm* — Dorsey & Whitney LLP

(57) ABSTRACT

The present invention relates to an extendable container for fluids with variable containment volume and dimensions, which comprises one or more elements independent and capable of relative movement among themselves.

9 Claims, 7 Drawing Sheets

(56) References Cited

FOREIGN PATENT DOCUMENTS

| | | | |
|---|---|---|---|
| DE | 102014018764 | B3 | 1/2016 |
| GB | 2537174 | A | 10/2016 |
| JP | 10-328061 | A | 12/1998 |
| JP | 2003129685 | A | 5/2003 |
| JP | 2003250856 | A | 9/2003 |
| WO | 2014067503 | A1 | 5/2014 |

* cited by examiner

EXTENDABLE CONTAINER FOR FLUIDS WITH VARIABLE CONTAINMENT VOLUME AND DIMENSIONS

FIELD OF APPLICATION

The present invention belongs to the field of mechanical, nautical and civil engineering and also architecture, more specifically reservoirs, tanks, swimming pools, bathtubs and the like.

INTRODUCTION

The present invention refers to an extendable container for fluids with constituent elements capable of relative movement among themselves, providing a reservoir with containment volume and variable total dimensions, being, therefore, also capable of being hidden or concealed.

BACKGROUND

Containers of varied build measurements are widely used by engineering and architecture in the construction of swimming pools, bathtubs and tanks, for various functions and uses.

Variation of one or more measurements can, for example, hide or conceal a bathtub or a swimming pool, vary the depth of a swimming pool, allow access and safety for people with special needs making use of bathtubs and many other possible applications.

STATE OF THE ART

Containers of various build measurements in the state of the art generally have a carcass or central, fixed structure, equipped with a mobile element such as the bottom, whose upward or downward movement varies the depth, decreasing or increasing it, respectively.

Examples of solutions of this nature are described by patent documents JP2003129685, US20100199416, U.S. Pat. Nos. 4,106,134, 10,072,432, DE20317102, CN108798086 and others that, even though they allow safe depth variation for a reservoir, they do not vary the total volume of the reservoir and also do not allow variations in the total dimensions of the reservoir, external and internal, which cannot be hidden or concealed.

There are also solutions in which one or more walls can be moved horizontally to promote variation of lateral measurements (width or length) or even those that provide bottoms with additional degrees of freedom, with a bottom that, in addition to moving vertically or horizontally, can also be tilted, as demonstrated by patent documents JP2003250856 and JP10328061, among many others. As in the previous cases, these also fail to provide the possibility of total volume variation or total external or internal dimension variation, not being suitable for more sophisticated builds that can be hidden or concealed.

As can be inferred from the above descriptions, there is space for a container for fluids capable of overcoming the deficiencies of the state of the art described above, in particular one that provides a container with constituent elements capable of relative movement among themselves, providing a reservoir with variable containment volume and total dimensions, being therefore also susceptible to being hidden or concealed.

OBJECTIVES OF THE INVENTION

The aim of the present invention is, therefore, to provide an extendable container for fluids with variable containment volume and dimensions.

BRIEF DESCRIPTION OF THE DRAWINGS

For better understanding and visualization of the subject matter, the present invention will now be described with reference to the appended figures, representing the obtained technical effect through exemplary embodiments without limiting the scope of the present invention, in which.

DETAILED DESCRIPTION OF THE INVENTION

Figure 1:
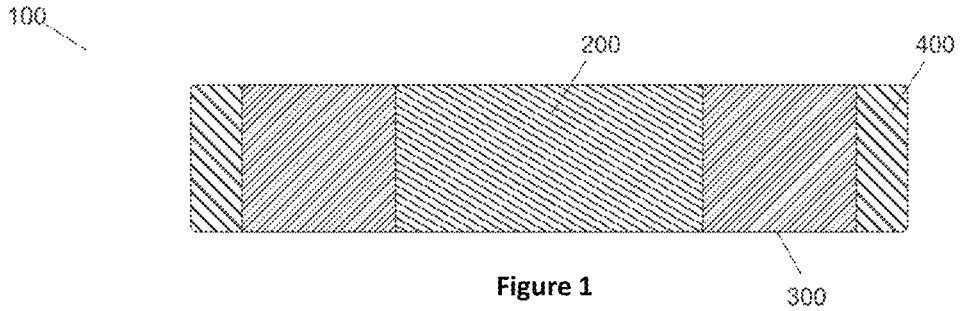
FIG. 1: presents a schematic side view in partial section of a container according to the invention, showing its elements aligned in a retracted or closed position.
Figure 2:
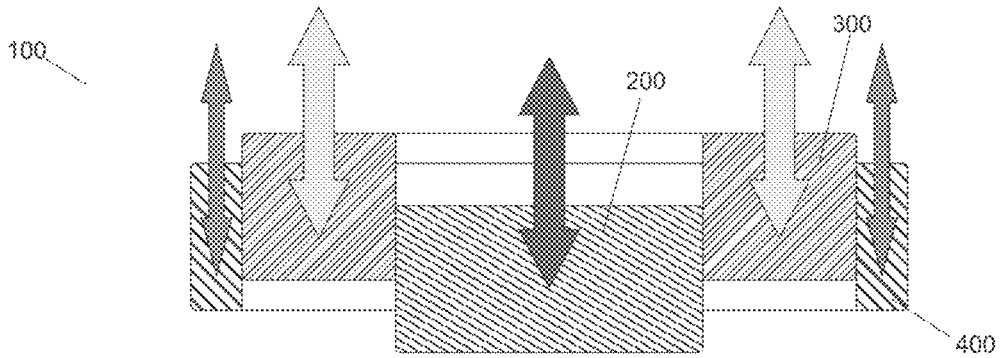
FIG. 2: presents a schematic side view in partial section of the container in FIG. 1, showing its elements in various relative positions, achieved by the independent movement of the elements.

A container (100) according to the invention comprises one or more independent elements (200, 300, 400) that can be moved relatively to one another.

The elements can be bottom (200) and/or seat (300) and/or backrest/containment (400), and may be present alone, in pairs, in groups of three or more, and so on.

Figure 11:
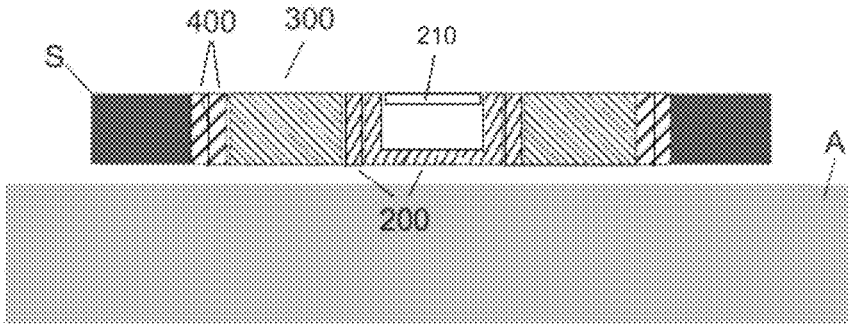
FIG. 11: presents a set of elements containing more than one element of each type with a lid and telescopic bottom with their elements aligned in a retracted or closed position.
Figure 12:
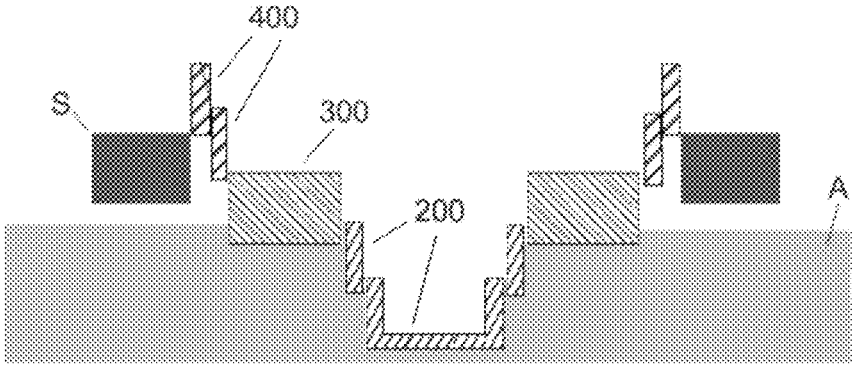
FIG. 12: presents the set of FIG. 11 with its elements having been moved in different directions forming containers with varied volumes.

The bottom (200), seat (300) and back/containment (400) elements are polygonal or circular or oval or mixed cross-section elements and independently activated, allowing the movement of one or more of the elements (200, 300, 400) in any direction, both horizontal and vertical, linear, oblique, rotational, this movement can be made as a set, in pairs or alone (only one element moves). A preferred movement of one or more of the elements (200, 300, 400) according to the invention is a movement in the vertical direction, both upwards and downwards. It should be noted that there may be one or more of each of the elements (200, 300, 400), for example two backrest/containment elements (400), one seat element (300) and two bottom elements (200) such as, for example, shown in FIGS. 11 and 12.

This relative independent movement between the elements (200, 300, 400) allows the container (100) to vary between an initial or retracted or closed position, in which all are aligned, and a series of numerous extended positions, in which the elements (200, 300, 400) can form an almost unlimited number of positional combinations, each with different total dimensions and containment volume, and one or more of the elements (200, 300, 400) may not have movement.

Positional combinations provide a container (100) capable of serving as a sitting or recreation place, with or without water (A) and always in a volume and dimensions adequate to the user's desire.

In this way, and depending on the size of the project, the container (100) according to the invention can serve as a swimming pool, bathtub, tank, water collector, etc.

The elements (200, 300, 400) of the container (100) can be hollow or solid, present as a set, in pairs or alone, without one or more of its side walls, upper or lower, equipped with complementary elements such as lids, drains, grates, screens or a combination of these possibilities, according to the desired application.

Figure 5A:
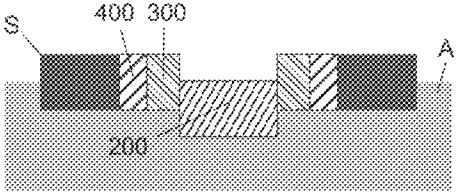
FIG. 5*a*: presents a schematic side view in partial section of a container according to the invention, built-in to a floating substrate and with its elements aligned in a retracted or closed position.
Figure 5B:
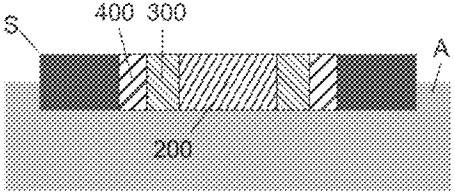
FIG. 5*b*: shows the container of FIG. 5*a* with its bottom element having been moved in a downward direction.
Figure 5C:
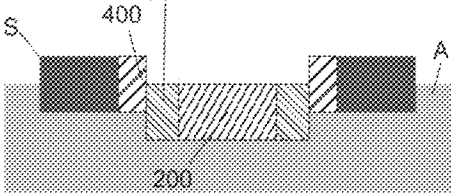
FIG. 5*c*: shows the container of FIG. 5*a* with its bottom and seat elements having been moved together in a downward direction.
Figure 5D:
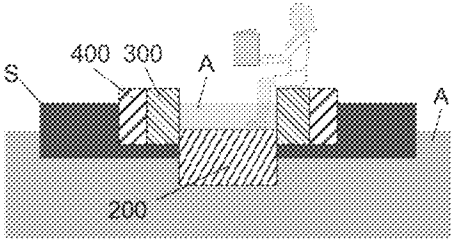
FIG. 5*d*: shows the container of FIG. 5*b* partially filled with water.
Figure 5E:
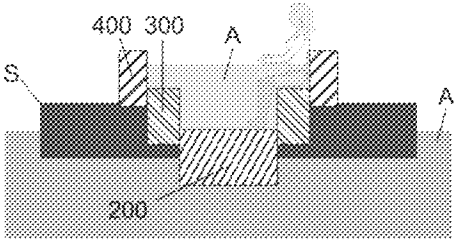
FIG. 5*e*: shows the container of FIG. 5*a* with its bottom, seat and backrest/containment elements having been moved in different directions forming a container with a containment volume greater than that of FIG. 5*d*.
Figure 5F:
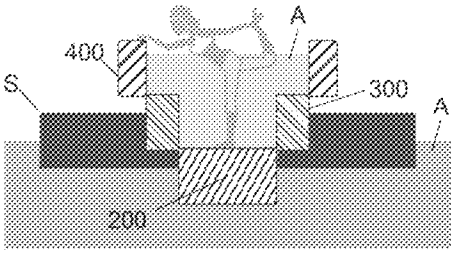
FIG. 5*f*: shows the container in FIG. 5*e* with its bottom, seat and containment elements having been moved in different directions up to their extreme (stop) positions, forming a container with a containment volume greater than that of FIG. 5*e;*
Figure 5G:
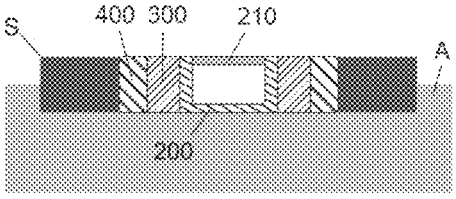
FIG. 5*g*: presents a schematic side view in partial section of a container according to the invention, built-in to a floating substrate and with its elements aligned in a retracted or closed position, with the bottom element provided with a removable lid.

An example of the absence of one of the walls is represented by FIG. 5*g*, which shows the bottom element (200), in a hollow version and equipped with a removable top lid (210), which replaces its top wall.

Figure 5H:
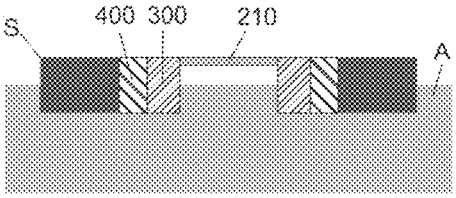
FIG. 5*h*: shows the FIG. 5*g* container with a removable lid and without the bottom element.

An example of the total absence of one of the elements is represented by FIG. 5*h*, which shows a container (100) without the bottom element (200), but with a removable lid (210). An alternative version could contemplate the complete absence of the lid and/or one or more of the elements (200, 300, 400).

The movement of the elements (200, 300, 400) of the container (100) is possible by means of any suitable traction device. Suitable traction devices are, but are not limited to, gears, spindles, levers, ratchets and the like, manual traction, electric, hydraulic or pneumatic motors, gravitational systems, capillary and/or communicating vessel systems and any others that are suitable for the substrate (S) and the conditions of use and application, alone or possibly in combination.

The activation of the elements (200, 300, 400) of the container (100) is, suitably, equally independent, and may be wired, wireless, via Bluetooth, radio frequency, cellular network, Internet, ultrasound, magnetic or any suitable means.

Figure 3:
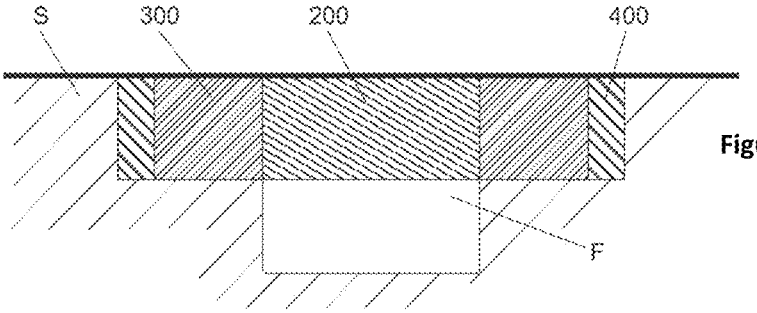
FIG. 3: presents a perspective side view in partial section of a container equipped with a container according to the invention, built-in to a substrate and with its elements aligned in a retracted or closed position.
Figure 4:
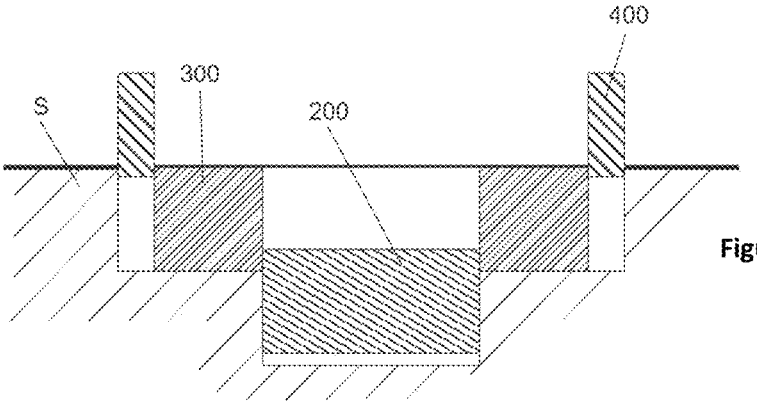
FIG. 4: presents a schematic side view in partial section of the container in FIG. 3, showing its elements in various relative positions, achieved by the independent movement of the elements.
Figure 4A:
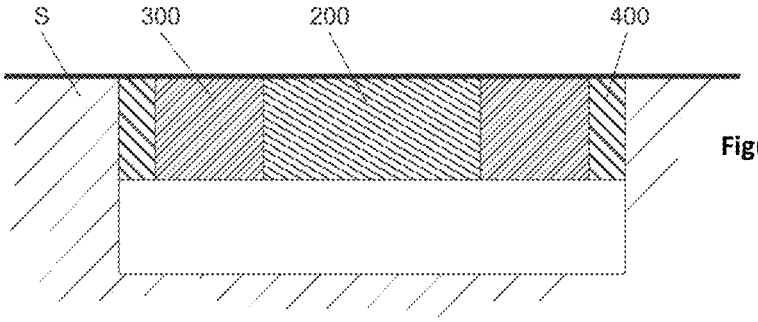
FIG. 4*a*: presents a schematic side view in partial section of the container according to the invention, built-in to a substrate with a total gap and with its elements aligned in a retracted or closed position.
Figure 4B:
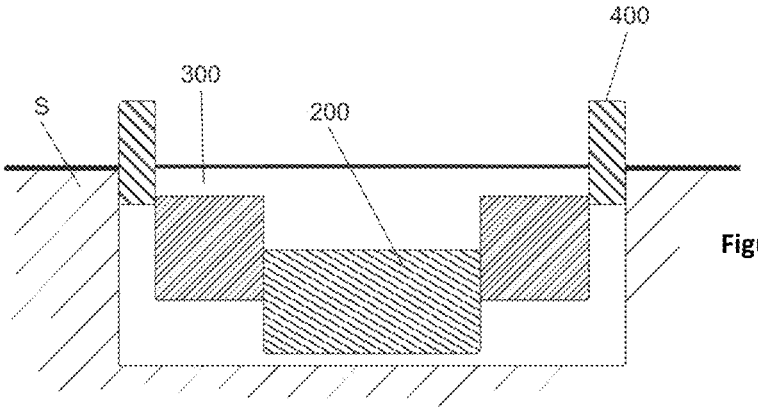
FIG. 4*b*: presents a schematic side view in partial section of the container in FIG. 4*a*, showing its elements in various relative positions, achieved by the independent movement of the elements.
Figure 6:
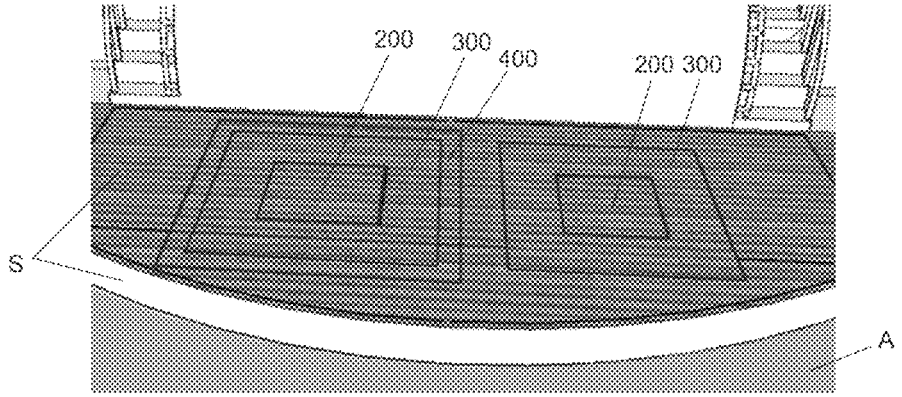
FIG. 6: presents a partial perspective view of two containers according to the invention, built-in to a substrate, such as the stern deck of a boat, and with their elements aligned in a retracted or closed position.
Figure 7:
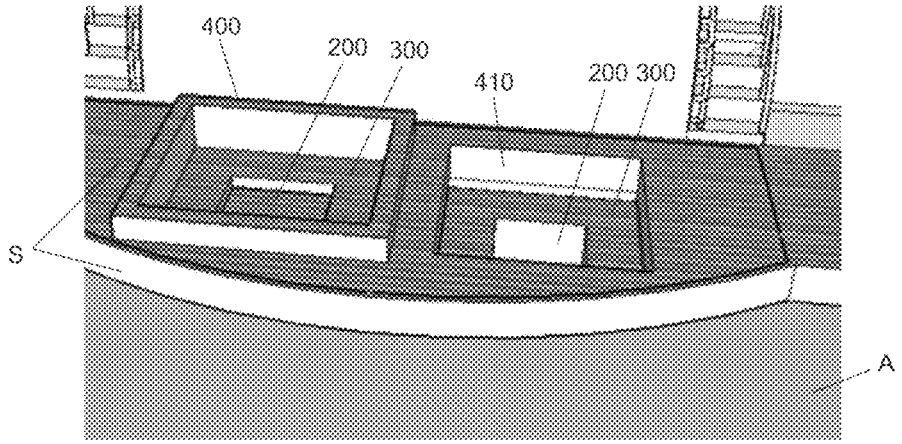
FIG. 7: presents the containers in FIG. 6 with their elements having been moved in different directions forming containers with varied volumes.
Figure 8:
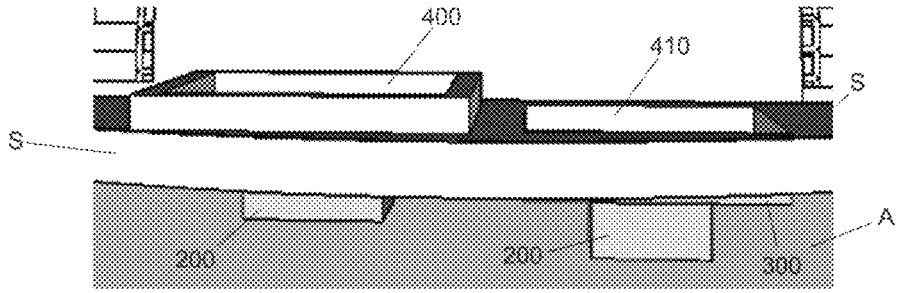
FIG. 8: presents a partial side view of the containers of FIG. 7.
Figure 9:
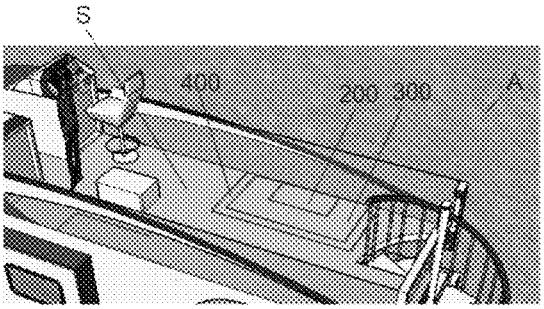
FIG. 9: presents a perspective view of a boat equipped with a container according to the invention installed on its cover and with its elements aligned in a retracted or closed position.
Figure 10:
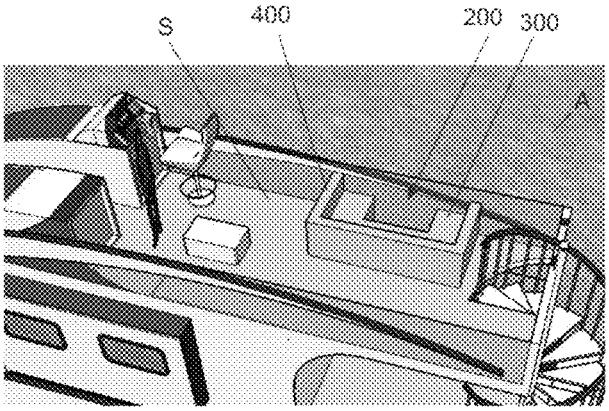
FIG. 10: presents the container of FIG. 9 with its elements having been moved in different directions forming containers with varied volumes.

The installation of the container (100) on a substrate (S) will depend precisely on the type of substrate (S) provided, which can be the ground with a gap (F) as shown in FIGS. 3 and 4, or a floating platform and/or submersible as shown in FIGS. 5*a*-5*e*, or a stern deck or a bow or cover of a boat as shown in FIGS. 6, 7 and 8.

Whether hollow, solid or combined, the elements (200, 300, 400) of the container (100) can have built-in piping and wiring, enabling the direct internal or indirect external installation of pumps and nozzles for hydro massage, lighting, massagers, heating, cooling, etc.

It is important to point out that, depending on the intended application, the elements (200, 300, 400) will need seals between their walls or not.

In the case of use as a swimming pool, bathtub or tank at or above the level of the substrate (S), it is necessary to have sealing elements to prevent leakage or infiltration from the external environment.

In the case of use as a submerged or submersible element, using the water (A) of the environment where it is located, the use of seals may be dismissed, and there may even be holes or openings in one or more of the bottom elements (200), seat (300) and backrest/containment (400) to facilitate entry of water (A).

In a preferred embodiment of the invention, the container (100) according to the invention comprises at least one bottom element (200) and at least one seat element (300), wherein the backrest/containment element (410) is formed by the walls of the gap (F) itself after the downward movement of the seat element (300).

In another preferred embodiment of the invention, the container (100) according to the invention comprises at least one bottom element (200) and at least one seat element (300), both movable and movable relatively to one another, while the backrest/containment element (400) is a separate detachable/fitted-in element, made in at least one piece.

In another preferred embodiment of the invention, the container (100) according to the invention comprises at least one bottom element (200) and at least one backrest/containment element (400), both movable and movable relatively to one another, while the seat element (300) is a fixed element.

In another preferred embodiment of the invention, the container (100) according to the invention comprises at least one fixed seat element (300), without the bottom element (200), but with a removable lid (210), while the backrest/ containment element (400) is a separate detachable/fitted-in element, made in at least one piece.

In another preferred embodiment of the invention, the container (100) according to the invention comprises at least one movable backrest/containment element (400) and at least one fixed seat element (300), without the bottom element (200), but with a removable lid (210).

Additional Benefits and Descriptions

The person skilled in the art will realize that the container (100) according to the invention solves several problems of the state of the art, providing a reservoir with containment volume and variable total dimensions, in addition to the capacity of being hidden or concealed.

In particular, its three-element embodiment (200, 300, 400) allows it to be built with a low total height in a retracted or closed state, allowing its use in the most varied situations, especially on boats and in the most varied places on the boat.

Conclusion

The present invention, therefore, provides a container (100) which, along with the aforementioned dimensions and characteristics, adds in a new and inventive way to the solutions to problems of the state of the art related to reservoirs, tanks, swimming pools, bathtubs and the like.

Final Remarks

It will be easily understood by those skilled in the art that modifications can be made to the present invention without departing from the concepts set out in the description above. Such modifications should be considered as included within the scope of the present invention. Consequently, the particular embodiments described in detail above are only illustrative and exemplary, and do not limit the scope of the present invention, which should be given the full extent of the appended claims and any and all equivalents thereof.

The invention claimed is:

1. An extendable container for fluids with a variable containment volume and dimensions, the extendable container comprising:

three or more elements that are independent and capable of relative movement among each other;

wherein the three or more elements are formed by: at least one bottom element or at least one removable top lid, at least one seat element, and at least one backrest/containment element;

wherein at least one of the three or more elements comprises at least one hole or opening to facilitate entry of water of an environment;

wherein each of the three or more elements of the extendable container are present alone, in pairs, or in groups of three or more;

wherein the extendable container is installed on a substrate including a floating or submersible platform for a stern deck, bow, or cover of a boat; and wherein the extendable container is capable of being hidden or concealed in said substrate where said extendable container is installed.

2. The extendable container according to claim 1, wherein the bottom, the seat, and the backrest/containment elements are present together, in pairs, or separately, and are equipped with at least one of a plurality of complementary elements including lids, drains, grids, screens, or a combination thereof.

3. The extendable container according to claim 1, wherein the extendable container varies between an initial position, a retracted position, or a closed position, in which all of the three or more elements are aligned.

4. The extendable container according to claim 1, wherein the movement of the three or more elements is performed by at least one of gears, spindles, levers, ratchets, manual traction, electric, hydraulic or pneumatic motors, gravitational systems, capillary and/or communicating vessel systems.

5. The extendable container according to claim 1, wherein activation of the three or more elements are independent via wireless, Bluetooth, radio frequency, cellular network, Internet, ultrasound, or magnetic.

6. The extendable container according to claim 1, wherein the three or more elements have built-in piping and wiring, enabling direct internal or indirect external installation of pumps and nozzles for hydromassage, lighting, massagers, heating, and cooling.

7. The extendable container according to claim 1, wherein the three or more elements have seals between walls thereof.

8. The extendable container according to claim 1, wherein the three or more elements include a backrest/containment element formed by walls of a gap, after the downward movement of one of the other of the three or more elements.

9. The extendable container according to claim 1, wherein one or more of the three or more elements has no movement in relation to the substrate.

* * * * *